United States Patent [19]

Ragland, Jr.

[11] 4,198,614

[45] Apr. 15, 1980

[54] DEFLECTION YOKE ASSEMBLY INCLUDING A BEAM POSITIONING MAGNET ARRANGEMENT

[75] Inventor: Frank R. Ragland, Jr., Lancaster, Pa.

[73] Assignee: RCA Corporation, New York, N.Y.

[21] Appl. No.: 958,021

[22] Filed: Nov. 6, 1978

[51] Int. Cl.[2] ..... H01F 3/12

[52] U.S. Cl. ..... 335/211; 335/212

[58] Field of Search ..... 335/210, 211, 212, 213, 335/214; 313/430

[56] References Cited

U.S. PATENT DOCUMENTS

| | | | |
|---|---|---|---|
| 2,854,598 | 9/1958 | Baermann | 313/430 |
| 2,900,544 | 8/1959 | Cunniff | 313/430 |
| 2,941,102 | 6/1960 | Reiches | 313/430 |
| 2,963,609 | 12/1960 | Fisher et al. | 335/211 |
| 3,701,065 | 10/1972 | Mirsch | 335/212 |
| 3,899,710 | 8/1975 | Machida et al. | 335/212 |

*Primary Examiner*—George Harris

*Attorney, Agent, or Firm*—E. M. Whitacre; P. J. Rasmussen

[57] ABSTRACT

A deflection yoke assembly includes a permanent magnet arrangement comprising first and second magnets magnetically coupled to act as a single magnet with variable strength by means of a magnetic shunt structure including castellated portions disposed adjacent to the two magnets.

9 Claims, 9 Drawing Figures

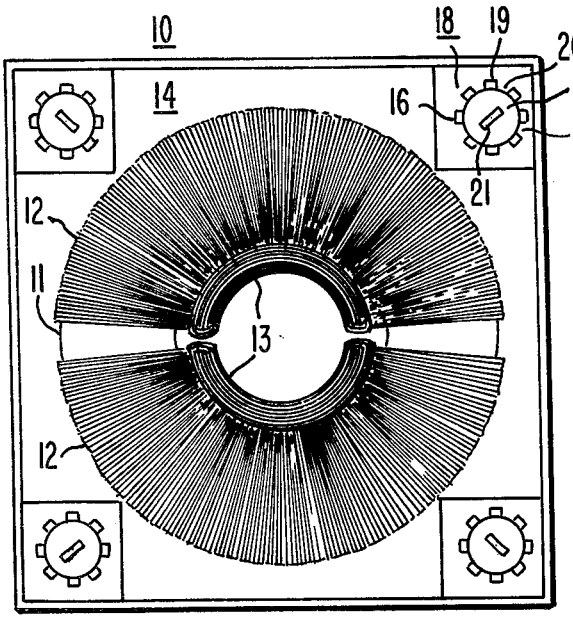
Fig. 1.
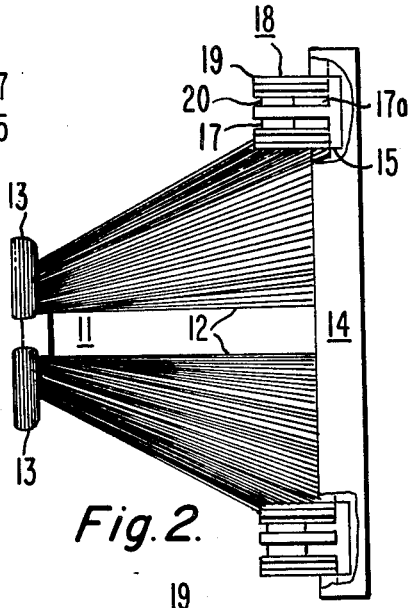
Fig. 2.
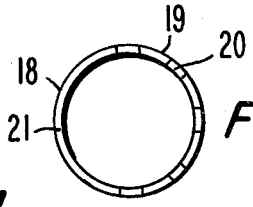
Fig. 9.
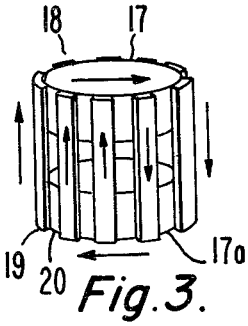
Fig. 3.
Fig. 4.
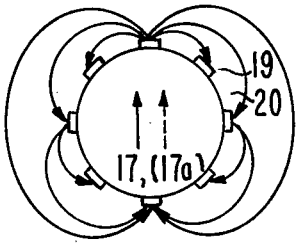
Fig. 7.
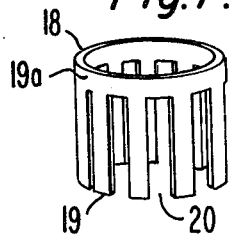
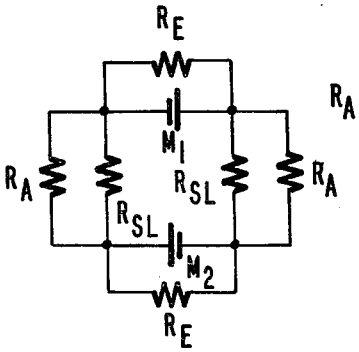
Fig. 5.
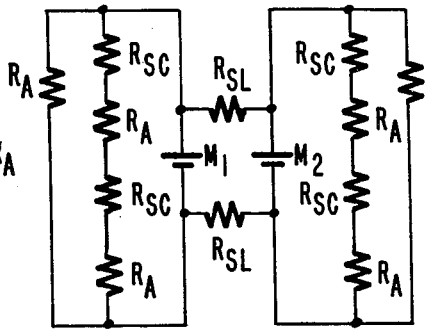
Fig. 6.
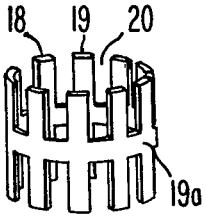
Fig. 8.

DEFLECTION YOKE ASSEMBLY INCLUDING A BEAM POSITIONING MAGNET ARRANGEMENT

BACKGROUND OF THE INVENTION

This invention relates to deflection yokes including a beam positioning magnet arrangement.

Multiple beam color picture tubes such as used in color television receivers generally require some arrangement for maintaining convergence of the three beams as they are deflected to form a raster to reproduce a color image on the viewing screen or to correct for various types of raster distortion such as pincushion distortion.

Picture tubes of the delta-gun type generally utilize a convergence assembly mounted on the neck of the picture tube with permanent magnets and dynamically energized electromagnets to maintain the desired beam convergence. Picture tubes of the in-line gun type utilize deflection yokes of the self-converging type in which the nonuniformity of the deflection fields is selected to maintain beam convergence. For various reasons such as the use of wide-deflection angle picture tubes and the use of different types of deflection yokes it has been necessary or desirable to supplement the above-described convergence arrangements with further apparatus. To this end it is known that permanent magnets can be appropriately located to modify the beam deflection fields to achieve the desired beam convergence or raster geometry.

As an aid to influencing one or more beams, perhaps at a particular portion or portions of the scanned raster, it is desirable to provide adjustment of the supplemental magnetic field direction and intensity. The former can be achieved by rotating the magnet poles. The latter has been achieved by substituting a different strength magnet or by rotating the poles of one magnet relative to the poles of another closely spaced magnet. When like poles overlap the greatest intensity field is produced; when opposite poles overlap the least intensity field is produced. A main problem with the rotatable magnet intensity control approach is that because the centers of the magnets are spaced from each other the fields cannot be cancelled at all points when opposite poles overlap. In the case of two equal intensity magnets the fields cancel only at a point midway between the magnets and are of opposite polarity in opposite directions away from the center. In the case of two unequal strength magnets with opposite poles overlapping the fields will cancel at two points away from the center distance between the magnets with net opposite polarity fields in opposite directions from each point.

When the poles of the two magnets are not directly opposed the general effect described above becomes much more complex, but, in general, it can be stated that the resultant field will change in intensity and polarity as a function of distance from the magnets. Obviously, these conditions make it very difficult, if not impossible, to trim exactly the main deflection field to achieve the desired beam or raster correction.

SUMMARY OF THE INVENTION

A deflection yoke assembly for a cathode ray tube includes a permanent magnet arrangement disposed relative to the deflection coils of said yoke for modifying the deflection field affecting an electron beam passing through the yoke. The arrangement comprises first and second magnets each having opposite magnetic pole regions and a magnetic field shunt structure disposed relative to said magnets for causing said magnets to appear substantially as a single magnet having opposite magnetic pole regions, the structure including castellated members disposed adjacent to the magnets for linking the magnetic fields of the magnets.

BRIEF DESCRIPTION OF THE DRAWING

FIGS. 1 and 2 illustrate views of a deflection yoke assembly embodying the invention;

FIGS. 3, 4, 7, 8 and 9 illustrate in more detail permanent magnet arrangements of FIG. 1; and FIGS. 5 and 6 are electrical circuit diagrams useful in explaining the operation of the magnet arrangements of the rest of the FIGURES.

DESCRIPTION OF THE INVENTION

In FIGS. 1 and 2, a deflection yoke assembly 10 includes a flared ferrite core 11. Toroidally wound core 11 is a vertical deflection coil comprising diametrically opposed coil halves 12. Disposed along the inside surface of core 12 is a pair of horizontal saddle type deflection coil halves 13 also disposed on opposite sides of the core 11.

The coil and core assembly is suitably fastened to a deflection yoke mount structure 14 which may be made of a plastic material. In corner portions 16 of the mount 14 are disposed a permanent magnet arrangement 18 located within a recess 15 of the corner portion 16. Each magnet arrangement includes first and second permanent magnets 17 and **17*a* each preferably including two opposite poles located at either end of a diameter of the magnet. The magnets are disposed next to each other within a magnetic field shunt structure including a series of castellated magnetically permeable members 19 surrounding the magnets. The castellated members 19 are separated from each other by spaces 20. One end of each of the castellated members 19 is contained in a press fit within a recess 15. This arrangement enables the shunt structure 18 to be rotated within the recess 15 and to be retained in the desired location. The top magnet 17 of the assembly may be rotated within the spaced castellated members by means of a suitable tool inserted in a slotted recess 21 of the magnet 17. The castellated members 19 exert pressure against the outside of the magnets to retain the magnets in the desired position after they have been rotated. Magnet 17*a* may be fixed within members 19 and it can be rotated by rotating the entire structure 18. Magnet 17 may then be rotated separately within members 19**.

FIG. 3 illustrates the effect of the magnetic field shunt structure 18. The magnets 17 and **17*a* disposed within the shunt structure are rotated to have their magnetic poles opposed to each other as indicated by the horizontal poling arrows adjacent to each of the magnets. The magnetic field from one magnet 17 to the other magnet 17*a* is shunted through the low reluctance members 19 to effectively short-circuit the magnets. The low reluctance shunt members 19** thus insure that relatively little magnetic field will escape from the assembly when the magnets are oppositely poled.

FIG. 5 is an electrical circuit diagram which is an electrical analog of the magnetic arrangement of FIG. 3. The sources $M_1$ and $M_2$ are equivalent to the oppositely poled magnets 17 and **17*a*. Resistances $R_{SL}$ represent the relatively low resistances of the low reluctance shunt members 19. The resistances $R_A$ represent the relatiely high reluctance air path in parallel with the shunt members. The resistances $R_E$ represent the return path for magnetic flux through the magnets 17 and 17a. Thus, it can be seen that a closed circuit is formed in which the magnetic flux from the sources $M_1$ and $M_2$ will be effectively contained to the closed circuit comprising the resistances $R_E$ and $R_{SL}$. Because the resistances $R_A$ is large relative to the resistances $R_{SL}$, very little magnetic flux will flow in this path. Thus, with the shunting arrangement described, the two magnets 17 and 17a act effectively as a single magnet and with the magnetic poles oppositely disposed in FIG. 3** very little magnetic flux escapes from the structure.

FIG. 4 is a top view of magnetic and castellated shunt member arrangement similar to that of FIG. 3. However, in FIG. 4, the two magnets 17 and 17a are relatively disposed so that their like magnetic poles overlap and are thus aiding. The shunt members 19 still act as an effectively short-circuit to the magnetic flux of the magnets but since the same magnetic potential exists at each end of the shunt members it is uneffective. The magnets are in parallel and the magnetic flux circuit must be completed outside the magnets. The flux thus travels as indicated by the flux lines from the one poling region of the magnets to the other.

FIG. 6 is an electrical analog of the permanent magnet arrangement with the magnets poled as in FIG. 4. The magnetic flux sources $M_1$ and $M_2$ are in parallel so no flux is carried through the resistances $R_{SL}$ representing the shunt members 19. However, part of the flux, as indicated in FIG. 4, travels from one pole of the magnets to the other through the path comprising the series arrangement of the shunt members $R_{SC}$ and the resistances of the air between the members $R_A$. There are actually as many effective resistances $R_{SC}$ and $R_A$ as there are members 19 and air spaces 20 located between the magnetic poles. The separated shunt members 19 now forces the flux to travel in the air between the shunt members. There is also a parallel path for flux illustrated by the single parallel resistance $R_A$. It is noted that all of the $R_A$'s need not be identical. Therefore, much of the magnetic flux travels from one pole of the magnetic to the other through the air represented by the single resistance $R_A$. In other words, the flux divides in accordance with the resistances of the individual paths. Thus, by properly positioning the poles of the magnets, the flux can be directed where desired in relation to the field of the deflection coils to modify the field to correct the convergence condition or raster geometry as desired.

It is to be understood that at points between the fully cancelling position of the arrangement shown in FIG. 3 and fully aiding position of the magnets shown in FIG. 4, that proportionate amounts of flux can be directed outside of the shunting structure to be used for control of the condition to be corrected. In all cases, the magnetic shunt members serve to magnetically link the magnetic flux from the two magnets to cause the two magnets to act effectively as a single magnetic source.

FIGS. 7, 8 and 9 illustrate variations of the arrangement of the shunt members 19 interspersed with air spaces 20. In FIG. 7, the shunt members 19 are fixedly held with respect to each other by the metal band portion 19a at one of their ends. In FIG. 8, the magnetic band portion 19a physically connects the shunt members 19 at their middle portions.

In FIG. 9, there is illustrated an arrangement in which shunt members 19 separated by air spaces 20 extend approximately 180° around a circle. The remaining 180° of the structure comprises a continuous solid shunt member 21 which affectively acts as a shield and permits flux to emanate only from that portion of the magnetic arrangement 18 containing the members 19 separated by air spaces 20. With this arrangement, the flux can be directed only to a given area and directed within that area by suitable rotation of one magnet relative to the other. In the FIG. 9 arrangement, the solid shunt member 21 or shield may extend for more or less than 180° as desired. Also, the individual shunt members 19 may be held by the joining band 19a either as illustrated in FIG. 7 or FIG. 8.

What is claimed is:

1. A deflection yoke assembly for a cathode ray tube including a permanent magnet arrangement disposed relative to the deflection coils of said yoke for modifying the deflection field affecting an electron beam passing through the yoke, said arrangement comprising:

first and second magnets each having opposite magnetic pole regions; and a magnetic field shunt structure disposed relative to said magnets for causing said magnets to appear substantially as a single magnet having opposite magnetic pole regions, said structure including castellated members disposed adjacent to said magnets for linking the magnetic fields of said magnets.

2. A deflection yoke assembly according to claim 1 wherein said magnets are cylindrical and at least one of said magnets is rotatable in relation to said castellated members to vary the strength of the magnetic field.

3. A deflection yoke assembly acccording to claim 2 wherein said magnets include opposite pole regions in a plane orthogonal to the central axis of said cylindrical magnets.

4. A deflection yoke assembly according to claim 3 wherein said castellated members extend parallel to the central axis of said magnets.

5. A deflection yoke assembly according to claim 4 wherein said castellated members are disposed around substantially the whole circumference of said magnets.

6. A deflection yoke assembly according to claim 5 wherein said castellated members are of substantially the same width measured around the circumference of said magnets.

7. A deflection yoke assembly according to claim 5 wherein at least one of said castellated members is of a substantially different width measured around the circumference of said magnets relative to the other of said castellated members.

8. A deflection yoke assembly according to claim 4 wherein said castellated members exert pressure against at least one of said magnets to enable rotation of said at least one magnet and to retain said at least one magnet in a desired rotational position.

9. A deflection yoke assembly according to claim 4 wherein said castellated members are disposed at one end thereof in a cylindrical recess in said yoke assembly for enabling rotation of said members and magnets relative to said recess and for retaining said members and magnets in a desired rotational position.

* * * * *